US005595085A

United States Patent [19]

Chen

[11] Patent Number: 5,595,085

[45] Date of Patent: Jan. 21, 1997

[54] ALUMINUM EXTRUDING MACHINE

[76] Inventor: Wu-Hsiung Chen, P.O. Box 82-144, Taipei, Taiwan

[21] Appl. No.: 601,605

[22] Filed: Feb. 14, 1996

[51] Int. Cl.[6] ..... B21C 23/20

[52] U.S. Cl. ..... 72/265; 72/255; 72/264

[58] Field of Search ..... 72/253.1, 255, 72/264, 265, 266, 272, 273, 273.5

[56] References Cited

U.S. PATENT DOCUMENTS

| | | | |
|---|---|---|---|
| 3,675,457 | 7/1972 | Groos | 72/265 |
| 4,050,281 | 9/1977 | Sibler | 72/265 |
| 4,223,548 | 9/1980 | Wagner et al. | 72/264 |
| 4,317,352 | 3/1982 | Doudet | 72/255 |
| 4,365,497 | 12/1982 | Asari | 72/255 |
| 4,475,372 | 10/1984 | Ostlinning et al. | 72/255 |
| 4,696,176 | 9/1987 | Asari et al. | 72/265 |
| 4,744,236 | 5/1988 | Asari et al. | 72/265 |

FOREIGN PATENT DOCUMENTS

| | | | |
|---|---|---|---|
| 3011134 | 10/1981 | Germany | 72/255 |
| 5138236 | 6/1993 | Japan | 72/255 |

*Primary Examiner*—Lowell A. Larson
*Assistant Examiner*—Ed Tolan
*Attorney, Agent, or Firm*—Alfred Lei

[57] ABSTRACT

An aluminum extruding machine which includes four guide rods connected between two opposite upright blocks above the machine base, a fixed die holder, a material carrying barrel moved on the guide rods relative to the die holder to carry molten aluminum, a push member with a tubular plunger moved along the guide rods to extrude molten aluminum out of the die holder, a center rod moved by a cylinder through the material carrying barrel into the center of the die holder to define an annular cavity within the die holder for the passing of extruded molten aluminum, and a cutter assembly driven by a cylinder to cut off extruded aluminum tube.

1 Claim, 11 Drawing Sheets

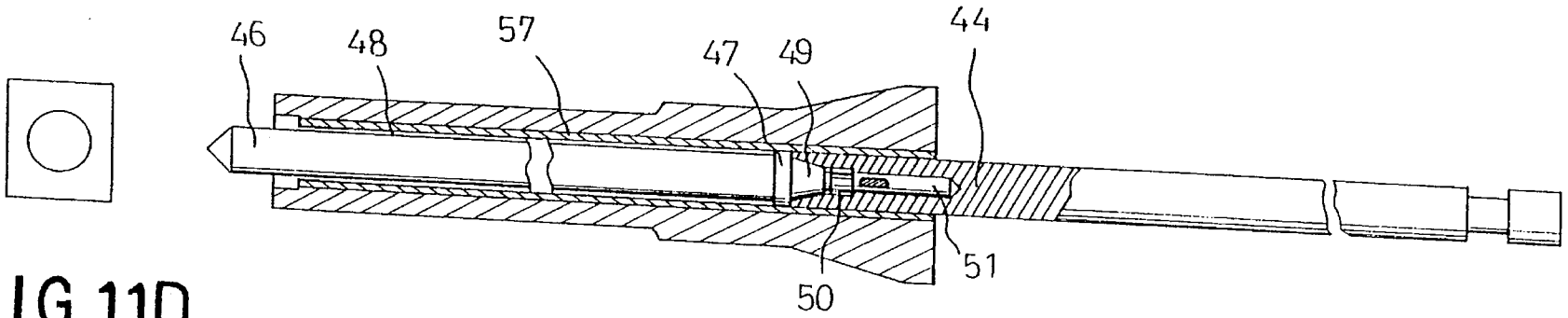
FIG. 11C
FIG. 11D
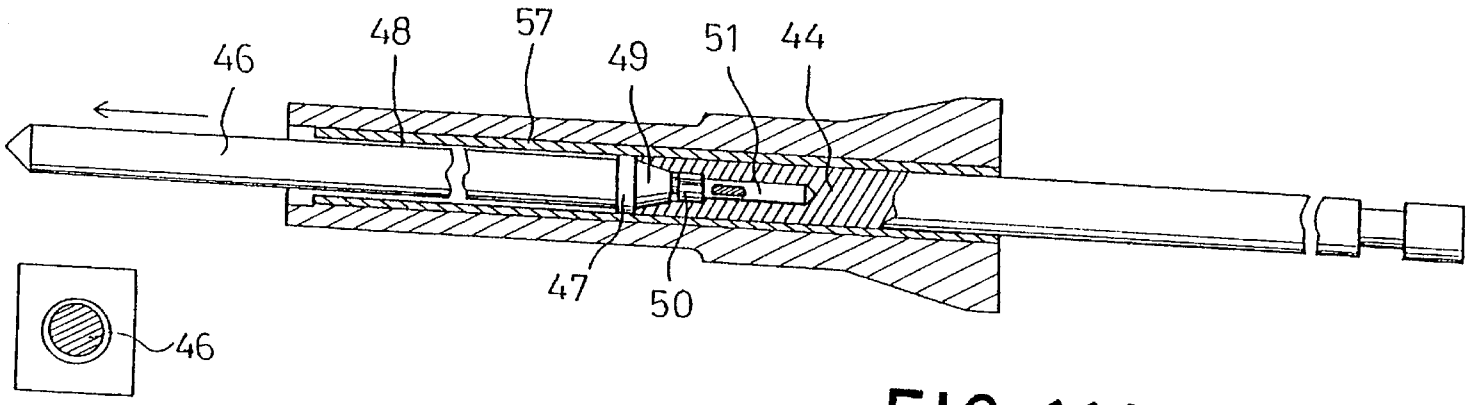
FIG. 11A
FIG. 11B

ALUMINUM EXTRUDING MACHINE

BACKGROUND OF THE INVENTION

1. Field of the Invention

This invention relates to aluminum extruding machines, and relates more particularly to an aluminum tube extruding machine which is stable in use and, which can produce seamless aluminum tubes.

2. Description of the Prior Art

FIG. 1A shows an aluminum extruding machine according to the prior art, which comprises two sliding tables 34 longitudinally disposed at two opposite sides, a material carrying barrel 37 connected to the piston rods 39 of two front cylinders 38 and moved on the sliding tables 34 relative to the die holder thereof, a push member 33 connected to the piston rods 35 of two rear cylinders (not shown) and moved on the sliding tables 34, a main cylinder 36 controlled to move a center rod into the die holder to define an annular cavity for the passing of the molten aluminum from the material carrying barrel, and a cutting control cylinder 40 having a cutter fixedly secured to its piston rods and moved to cut off extruded aluminum tube. This structure of extruding machine is not stable in use because the push member tends to vibrate when it is moved to force its tubular plunger into the annular cavity inside the die holder. Because the cutter is directly fastened to the piston rod of the respective cylinder, it may vibrate while cutting. Furthermore, because the die has three slots (see FIGS. 1B and 1C), an uneven stress tends to occur during the extruding process, and the extruded aluminum tube will have a detective surface.

SUMMARY OF THE INVENTION

This invention relates to an aluminum extruding machine.

According to the preferred embodiment of the present invention, the aluminum extruding machine comprises four guide rods connected between two opposite upright blocks above the machine base, a fixed die holder, a material carrying barrel moved on the guide rods relative to the die holder to carry molten aluminum, a push member with a tubular plunger moved along the guide rods to extrude molten aluminum out of the die holder, a center rod moved by a cylinder through the material carrying barrel into the center of the die holder to define an annular cavity within the die holder for the passing of extruded molten aluminum, and a cutter assembly driven by a cylinder to cut off extruded aluminum tube. The cutter assembly comprises a cylinder block, a sliding block reciprocated by a cylinder along two longitudinal rails inside the cylinder block, and a cutter fixedly secured to the bottom side of the sliding block. Because the material carrying barrel and the push member are mounted on the guide rods and supported on the sliding tables, the movement of the push member is stable during the extruding operation. Because the sliding block of the cutter assembly is reciprocated by the respective cylinder along the longitudinal rails, the cutting operation of the cutter is accurate and stable. Furthermore, because the die holder has a smooth inside wall and, the center rod is a solid rod and defines with the die holder an integral annular cavity, the extruded aluminum tube has no seam.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

BRIEF DESCRIPTION OF THE DRAWINGS

FIG. 11A is a longitudinal view in section showing the center rod connected to the connecting rod and moved backed in the tubular plunger according to the present invention;

FIG. 11B is a cross section of FIG. 11A;

FIG. 11C is similar to FIG. 11A but showing the center rod extended out of the tubular plunger; and FIG. 11D is a cross section of FIG. 11C.

DETAILED DESCRIPTION OF THE PREFERRED EMBODIMENT

Figure 1A:
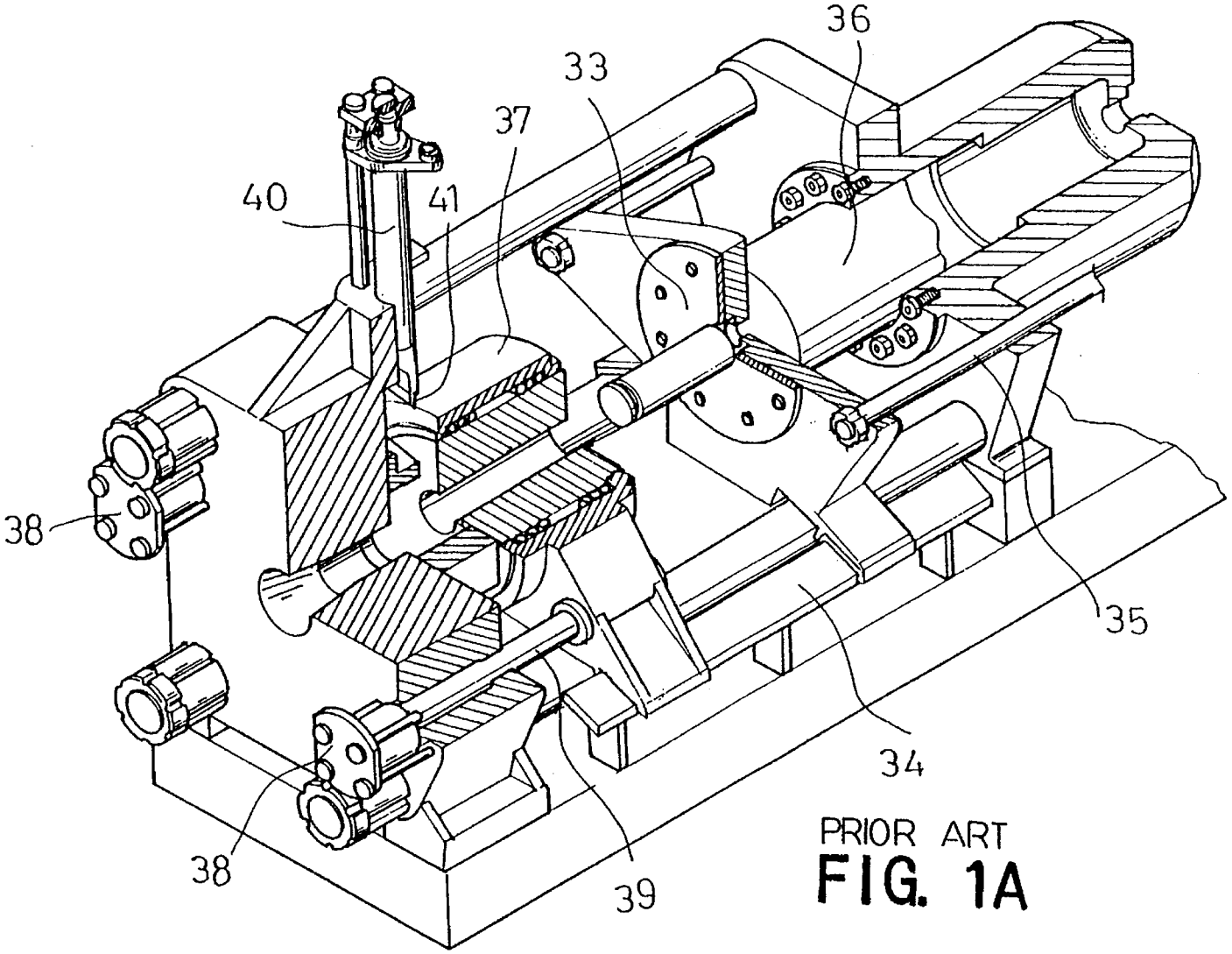
PRIOR ART FIG. 1A
FIG. 1A is a cutaway of an aluminum extruding machine according to the prior art.
Figure 1B:
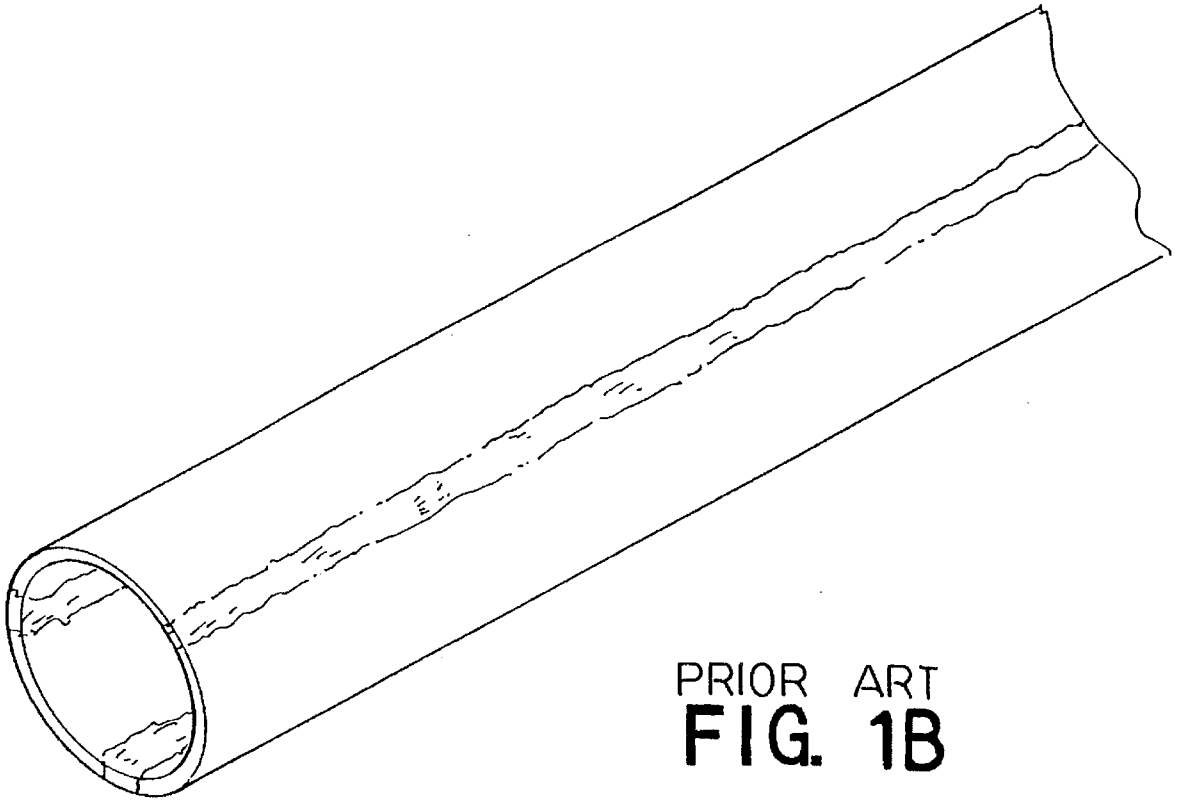
PRIOR ART FIG. 1B
FIG. 1B shows the structure of an aluminum tube extruding die for the aluminum extruding machine shown in FIG. 1A.
Figure 1C:
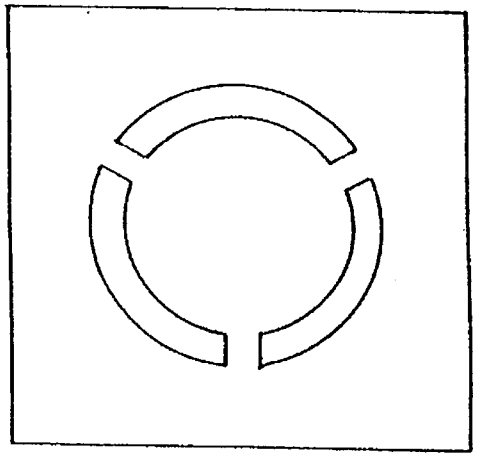
PRIOR ART FIG. 1C
FIG. 1C is a cross section of the aluminum tube extruding die shown in FIG. 1B.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 3:
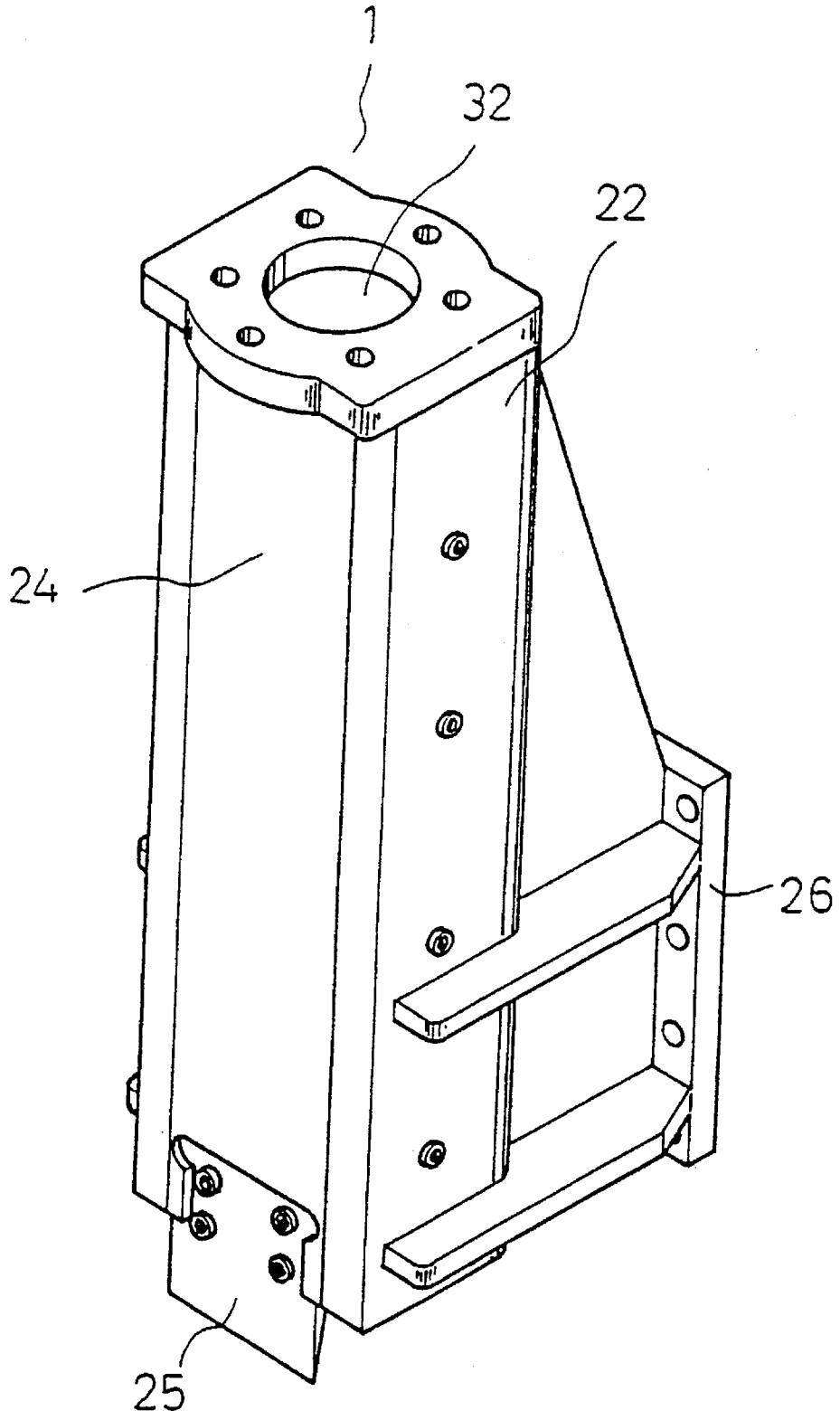
FIG. 3 is an elevational view of the cutter assembly of the aluminum extruding machine shown in FIG. 2.
Figure 4:
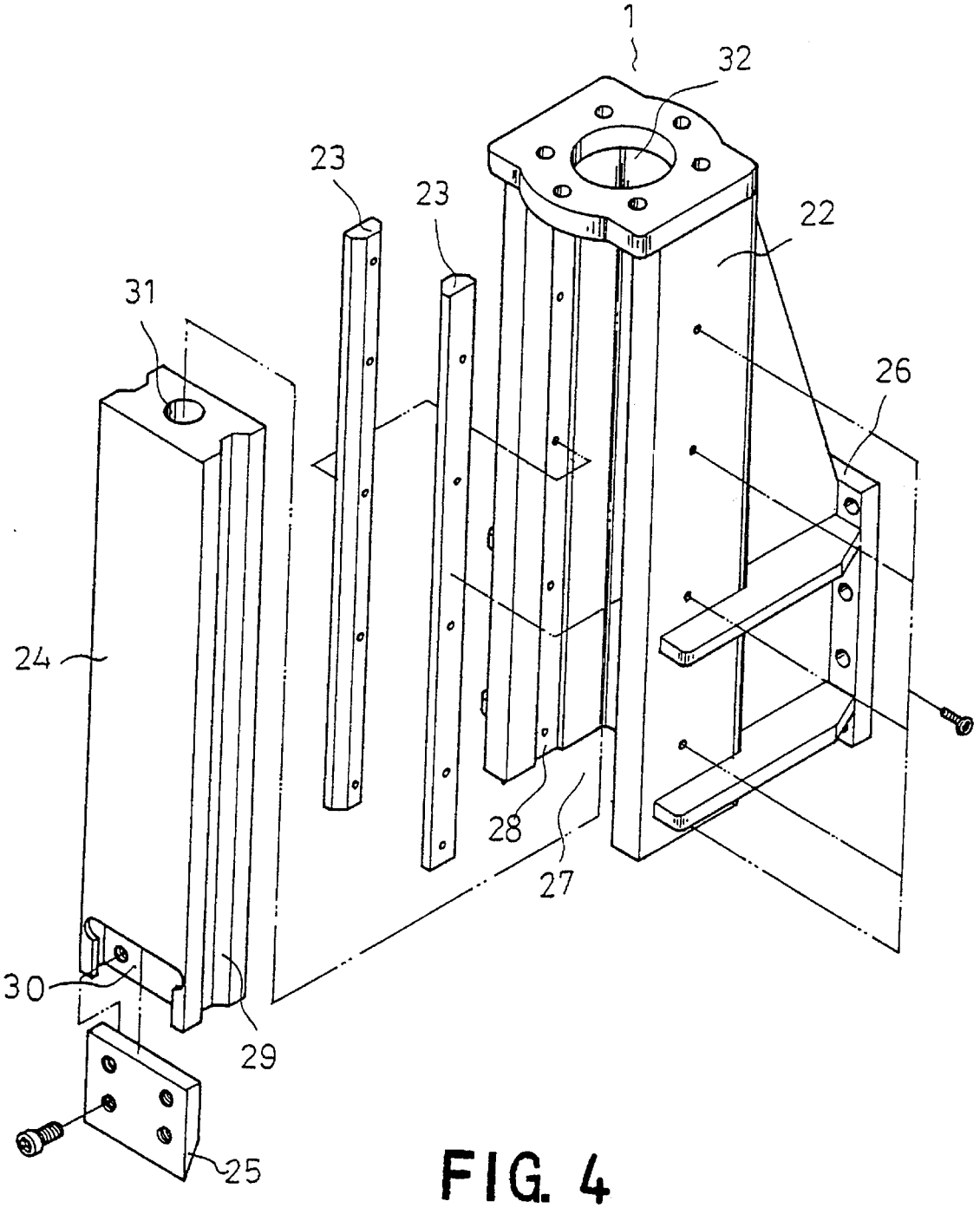
FIG. 4 is an exploded view of the cutter assembly shown in FIG. 3.
Figure 5B:
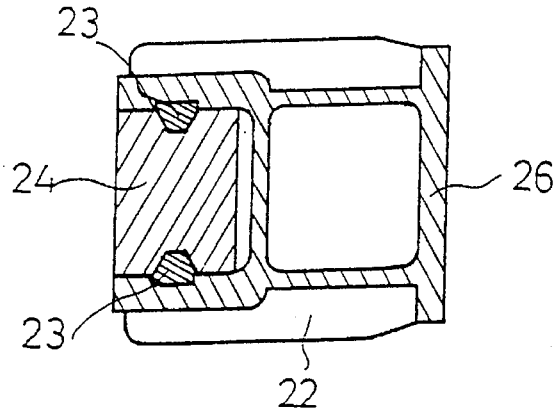
FIG. 5B is a cross section of FIG. 5A.
Figure 5A:
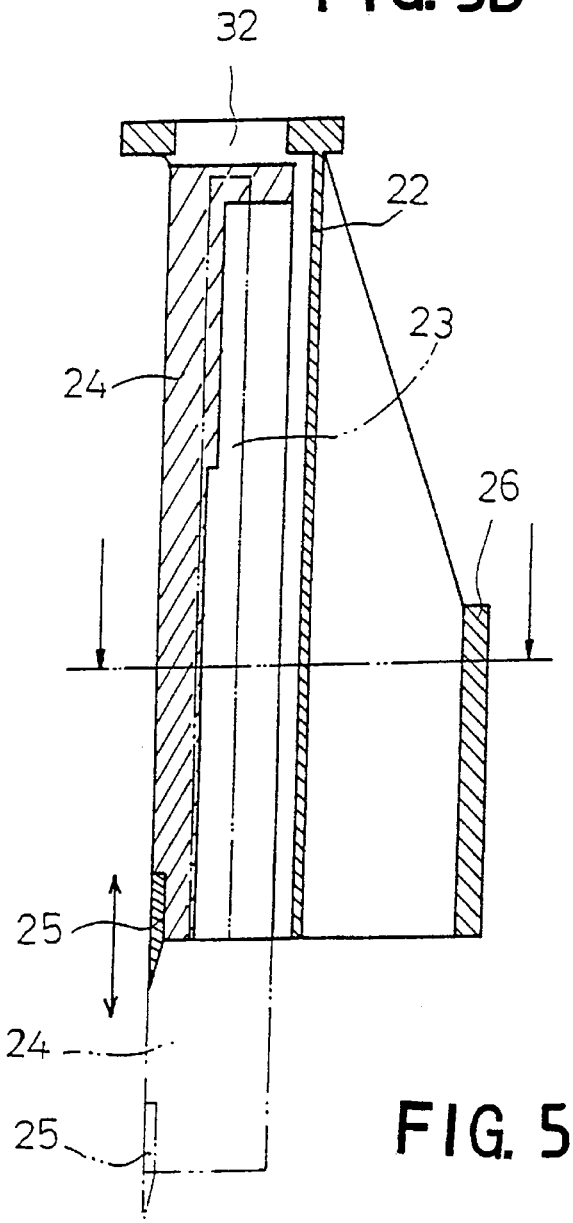
FIG. 5A is a longitudinal view in section of the cutter assembly shown in FIG. 3.

Referring to FIGS. 3 and 4, the cutter assembly, referenced by 1, is comprised of a cylinder block 22, two rails 23, a sliding block 24, and a cutter 25. The cylinder block 22 has a mounting frame 26 at the back side, a longitudinal side opening 27 at the front side, two longitudinal mounting grooves 28 bilaterally disposed inside the longitudinal side opening 27, and a circular top opening 32. The two rails 23 are respectively and fixedly fastened to the longitudinal mounting grooves 28. The sliding block 24 has a rectangular shape, two longitudinal sliding grooves 29 at two opposite sides, a cutter holder portion 30 at the bottom side, which holds the cutter 25, and a screw hole 31 at the top side. When the sliding block 24 is inserted into the cylinder block 22, the longitudinal sliding grooves 29 are forced into engagement with the rails 23. When installed, the sliding block 24 can be reciprocated in the longitudinal direction along the rails 23 (see FIG. 5A). A reciprocating rod (not shown) is inserted into the circular top opening 32 of the cylinder block 22 and fixedly fastened to the screw hole 31 of the sliding block 24.

Figure 2:
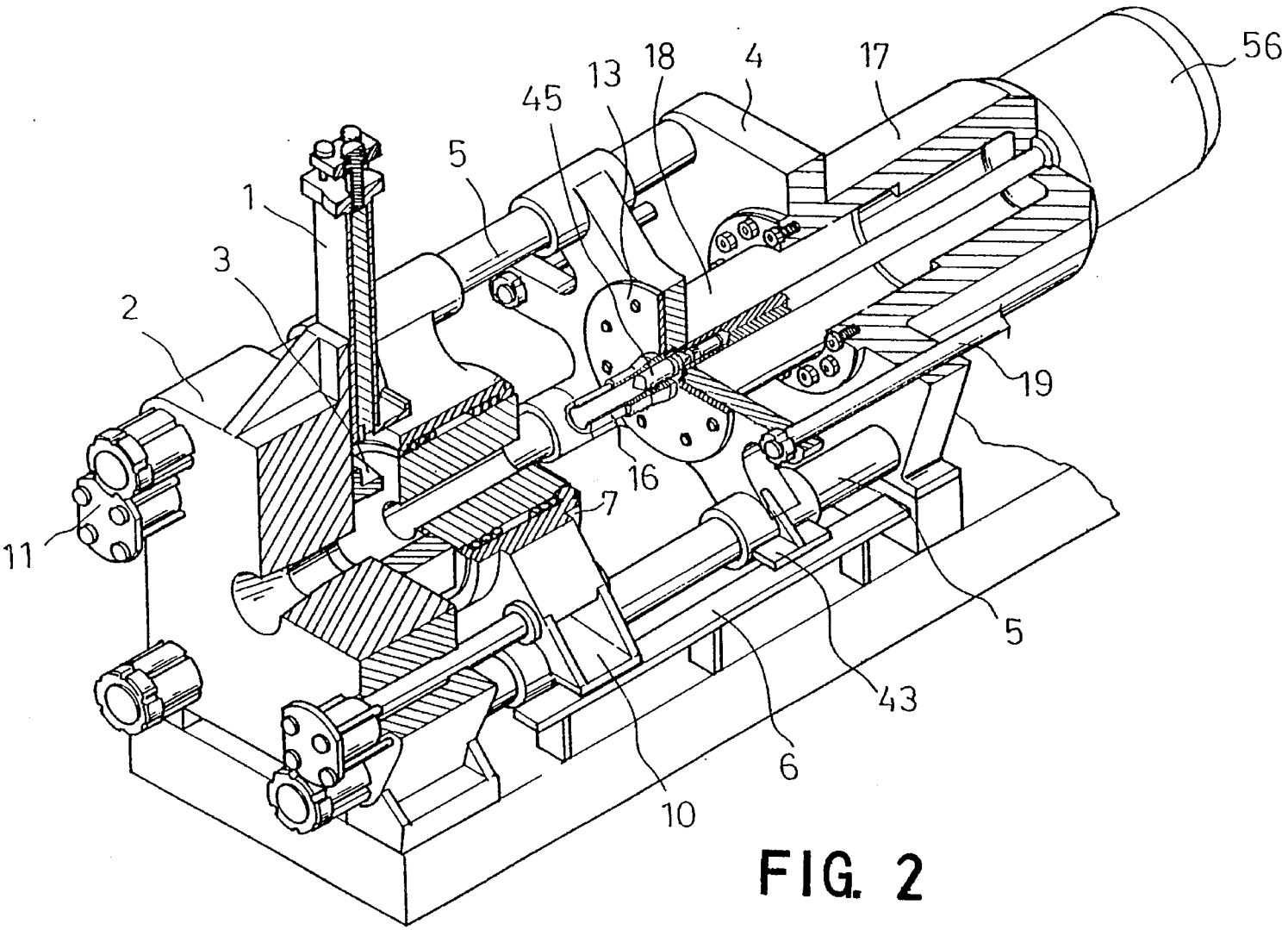
FIG. 2 is a cutaway of an aluminum extruding machine according to the present invention.
Figure 6A:
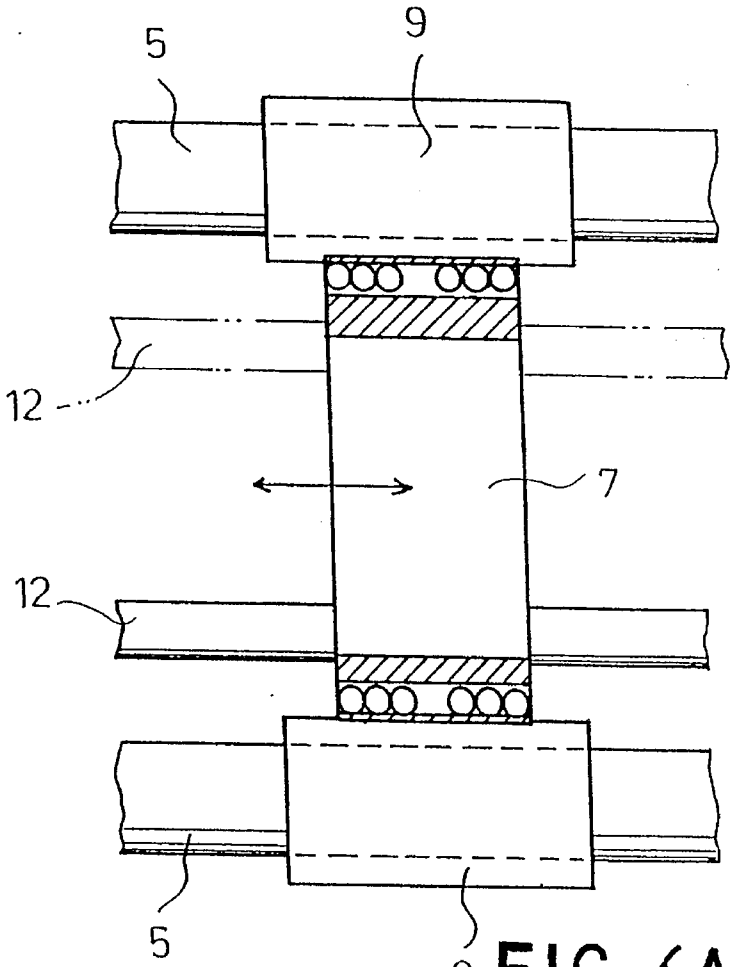
FIG. 6A is a side plain view showing the material carrying barrel moved along the guide rods according to the present invention.
Figure 6B:
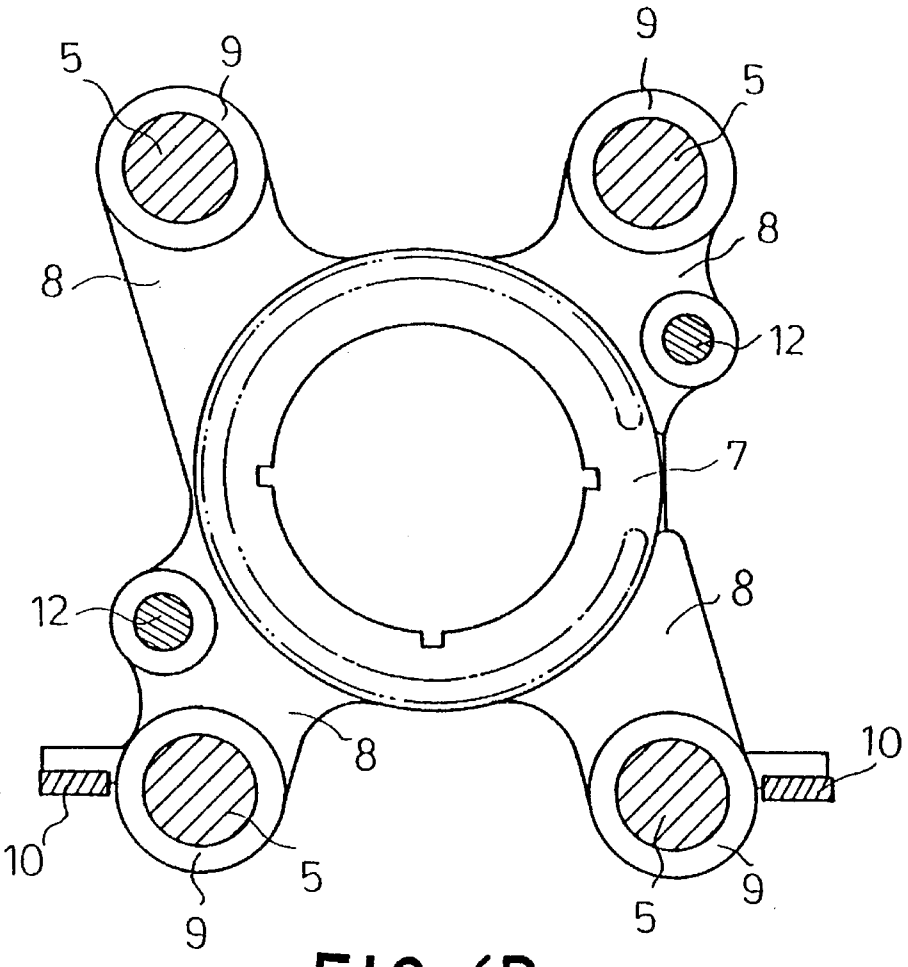
FIG. 6B is a cross section of FIG. 6A.

Referring to FIGS. 2, 6A, and 6B, an upright front block 2 and an upright rear block 4 are respectively raised from the machine base at two opposite ends. A die holder 3 is fixedly secured to the center of the upright front block 2. The mounting frame 26 of the aforesaid cylinder block 22 is fixedly secured to the upright front block 2 at an inner side above the die holder 3. Four guide rods 5 are symmetrically mounted between the upright front block 2 and the upright rear block 4 in four corners. Two sliding tables 6 are longitudinally disposed disposed at two opposite sides between the upright front block 2 and the upright rear block 4. A material carrying barrel 7 is disposed in front of the die holder 3. The aluminum ingot carrying barrel 7 has four projecting blocks 8 equiangularly spaced around the periphery, and four bearing blocks 9 respectively and fixedly mounted in the projecting blocks 8 and respectively sleeved onto the guide rods 5 (see FIGS. 6A and 6B). The two lower bearing blocks of the four bearing blocks 9 have a respective sliding leg 10 respectively and slidably supported on the sliding tables 6. Two rear cylinders 11 are diagonally mounted in the upright front block 2 with the respective piston rods 12 respectively connected to two diagonal projecting blocks of the four projecting blocks 8 of the material carrying barrel 7. Therefore, when the air cylinders 11 are operated, the material carrying barrel 7 is moved along the guide rds 5 and the sliding tables 6.

Figure 7A:
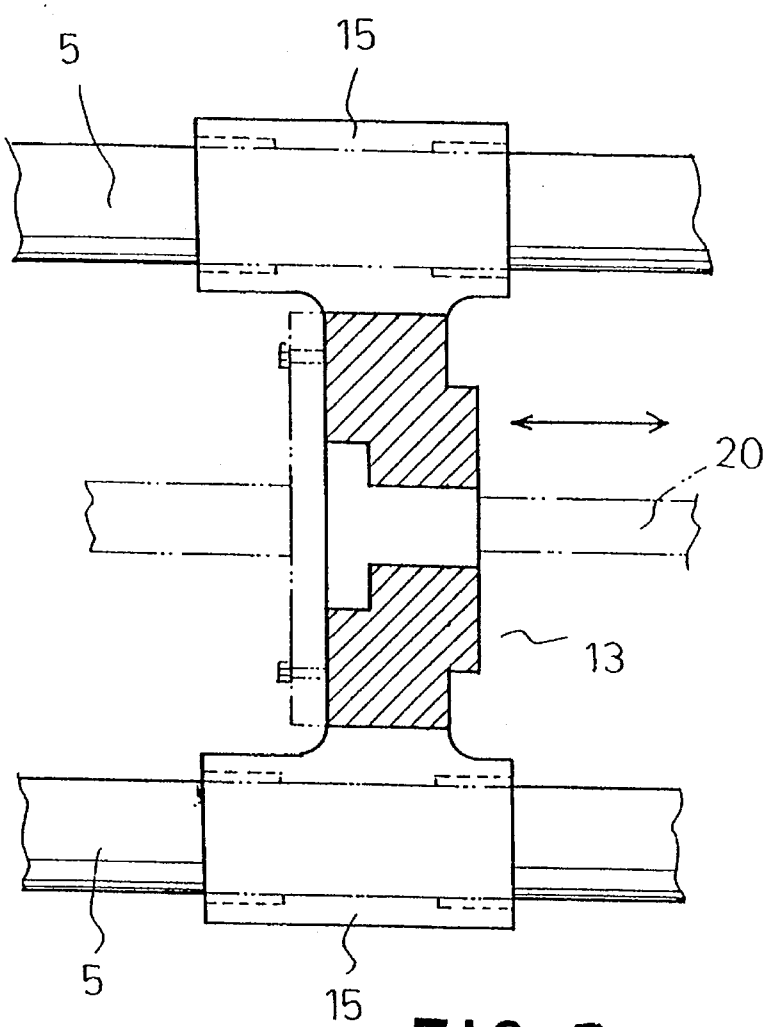
FIG. 7A is a side plain view showing the push member moved along the guide rods according to the present invention.
Figure 7B:
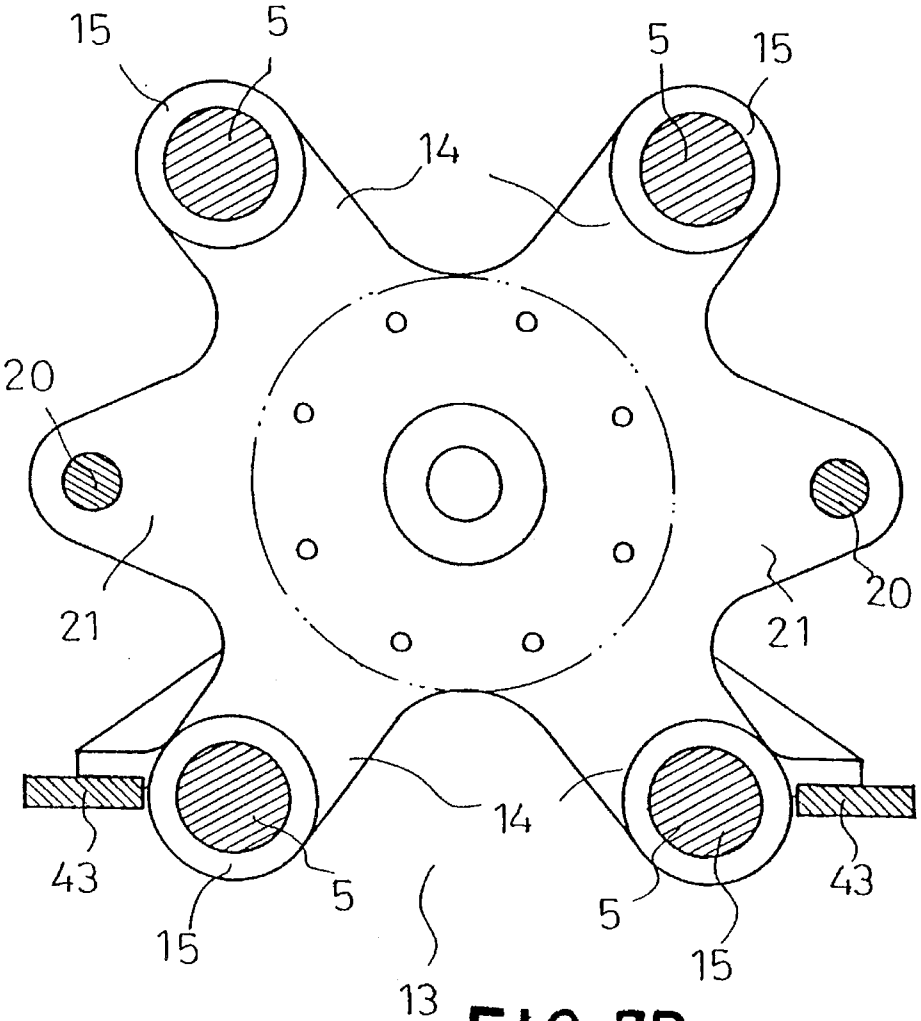
FIG. 7B is a cross section of FIG. 7A.
Figure 8B:
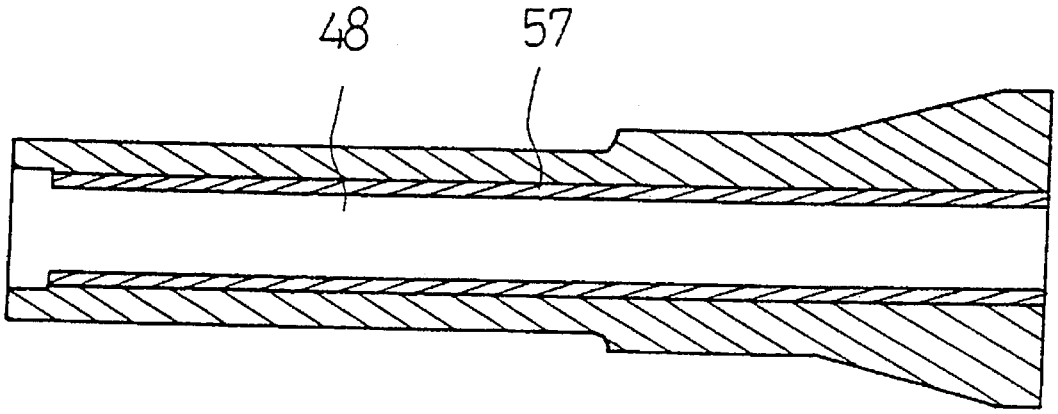
FIG. 8B is a longitudinal view in section of FIG. 8A.
Figure 8A:
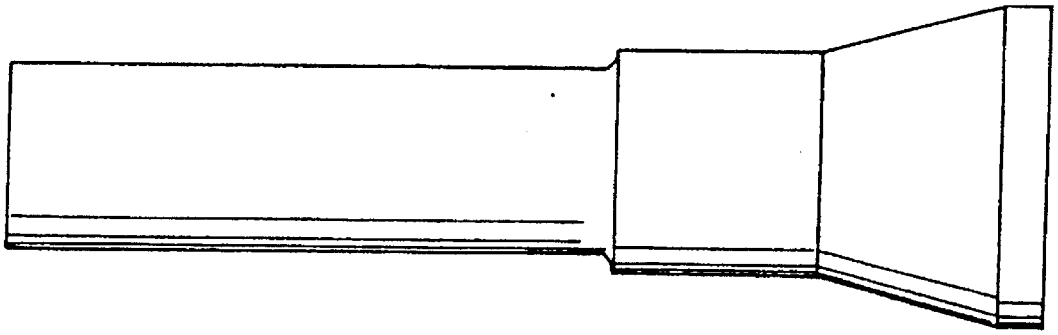
FIG. 8A is an elevational view in an enlarged scale of the connecting tube according to the present invention.
Figure 9B:
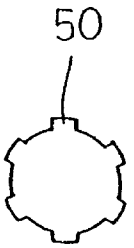
FIG. 9B is a cross section of the toothed portion of the center rod shown in FIG. 9A.
Figure 9A:
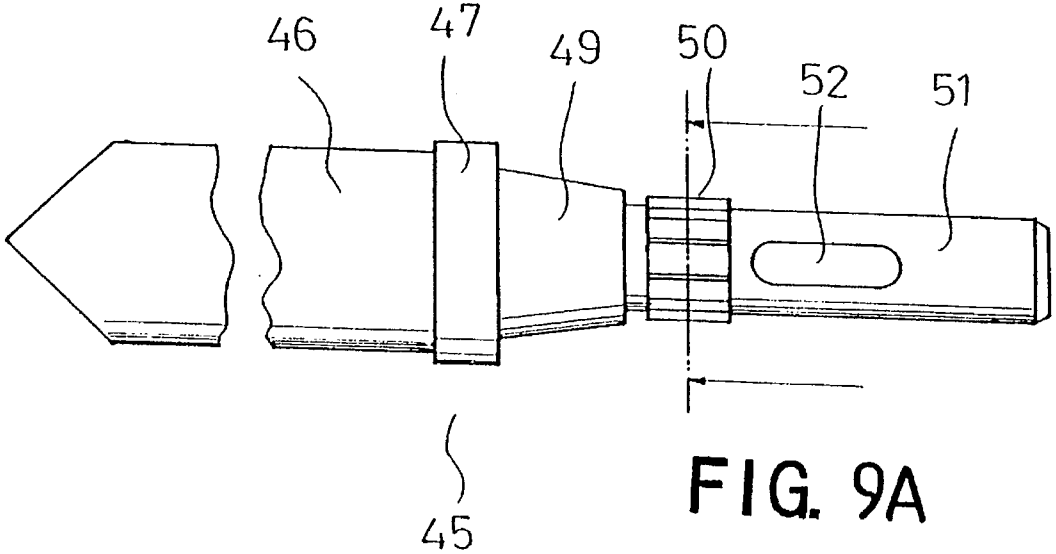
FIG. 9A shows the structure of the center rod according to the present invention.
Figure 10A:
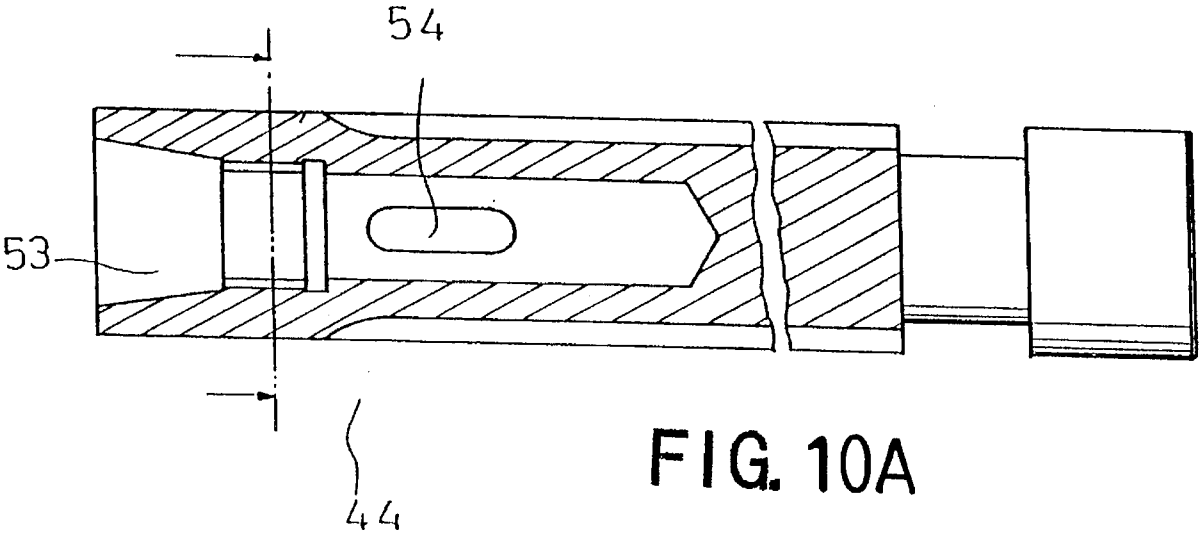
FIG. 10A is a longitudinal view in section in an enlarged scale of the connecting rod according to the present invention.
Figure 10B:
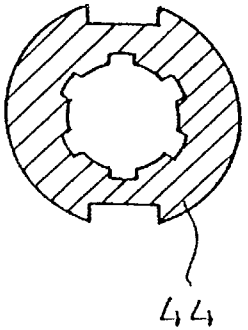
FIG. 10B is a cross section of the connecting rod shown in FIG. 10A.

Referring to FIGS. 7A and 7B, and FIG. 2 again, a push member 13 is slidably mounted on the guide rods 5. The push member 13 comprises four projecting blocks 14 equiangularly spaced around the periphery, and four bearing blocks 15 respectively and fixedly mounted in the projecting blocks 14 and respectively sleeved onto the guide rods 5. The two lower bearing blocks of the four bearing blocks 15 have a respective sliding leg 43 respectively and slidably supported on the sliding tables 6. The push member 13 further comprises a plunger 16 at the front side. The main cylinder, referenced by 17, is mounted in the upright rear block 4 with its piston rod 18 fixedly connected to the push member 13. Two front cylinders 19 are mounted in the upright front block 4 at two opposite sides relative to the main cylinder 17. The piston rods 20 of the front cylinders 19 are respectively connected two opposite projecting portions 21 of the push member 13.

Referring to FIGS. from 8A to 11D, the plunger 16 has a longitudinal center through hole 48, and a copper tube 57 mounted in the longitudinal center through hole 48. A center rod 45 is mounted in the copper tube 57 and moved in and out of the plunger 16. A connecting rod 44 is inserted into the copper tube 57 of the plunger 16 and connected between the center rod 45 and the auxiliary cylinder 56 at the rear end of the main cylinder 17. The center rod 45 comprises a cylindrical front rod section 46 terminating in a conical tip, a cylindrical rear rod section 51 of smaller cross section relative to the cylindrical front rod section 46, a tapered intermediate rod section 49 connected between the cylindrical front rod section 46 and the cylindrical rear rod section 51, a collar 47 disposed between the cylindrical front rod section 46 and the tapered intermediate rod section 49, a toothed portion 50 around the periphery of the cylindrical rear rod section 51 adjacent to the tapered intermediate rod section 49, and a longitudinal slot 52 through the cylindrical rear rod section 51. The connecting rod 44 has a longitudinal coupling hole 53, which receives the cylindrical rear rod section 51 and tapered intermediate rod section 49 of the center rod 45, and a longitudinal slot 54 connected to the longitudinal slot 52 of the center rod 45 by a pin (not shown). The outer diameter of the connecting rod 44 is approximately equal to that of the collar 47 of the center rod 45. When the center rod 45 and the connecting rod 44 are connected together, the connecting rod 44 is stopped at the collar 47, and the toothed portion 50 is meshed with the inside wall of the connecting rod 45.

Referring to FIGS. 2, 11A, and 11C again, when the aluminum ingot is melted in the material carrying barrel 7, the auxiliary cylinder 56 is operated to move the center rod 45 through the material carrying barrel 7 into the die holder 3, and therefore an annular cavity is formed within the die holder 3. When the annular cavity is formed within the die holder 3, the push member 13 is moved forwards to force the plunger 16 through the material carrying barrel 7 into the annular cavity, and therefore an aluminum tube is extruded. When an aluminum tube is extruded out of the die holder 3, the cutter 25 of the cutter assembly 1 is driven to cut off the aluminum tube.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An aluminum extruding machine of the type comprising a machine base, an upright front block and an upright rear block raised from said machine base at two opposite ends, four guide rods symmetrically connected between said upright front block and said upright rear block, a die holder fixedly secured to said upright front block at an inner side, a material carrying barrel moved along said guide rods relative to said die holder to carry molten aluminum, a push member moved along said guide rods relative to said material carrying barrel and having a tubular plunger forced through said material carrying barrel into said die holder to extrude molten aluminum out of said die holder, first reciprocating means controlled to move said material carrying barrel along said guide rods, second reciprocating means controlled to move said push member along said guide rods, a center rod moved into said die holder to define an annular cavity within said die holder for permitting molten aluminum to be extruded out of said die holder by said plunger, third reciprocating means controlled to move said center rod into said die holder, and a cutter assembly controlled to cut off extruded aluminum tube from said die holder, wherein:

said cutter assembly comprises a cylinder block having a mounting frame at a back side thereof fixedly secured to said upright front block, a longitudinal front opening at a front side thereof, two longitudinal rails bilaterally disposed within said longitudinal front opening, and a circular top opening, a sliding block moved along the longitudinal rails of said cylindrical block, a cylinder having a piston rod inserted through the circular top opening of said cylindrical block and fixedly connected to said sliding block at the top, and a cutter fixedly secured to said sliding block at the bottom;

two sliding tables are longitudinally located on said machine base at two opposite sides between said upright front block and said upright rear block to guide the movement of said material carrying barrel and said push member;

said material carrying barrel comprises four projecting blocks equiangularly spaced around the periphery of said barrel, four bearing blocks respectively and fixedly mounted in the projecting blocks of said material carrying barrel and respectively sleeved onto said guide rods, two sliding legs downwardly outwardly extending from two of the bearing blocks of said material carrying barrel and slidably supported on said sliding tables;

said push member comprises four projecting blocks equiangularly spaced around the periphery of said push member, four bearing blocks respectively and fixedly mounted in the projecting blocks of said push member and respectively sleeved onto said guide rods, two sliding legs downwardly outwardly extending from two of the bearing blocks of said push member and slidably supported on said sliding tables, and two projecting portions at two opposite sides respectively fastened to said second reciprocating means;

said tubular plunger has a copper tube mounted on the inside;

said center rod is inserted through said copper tube and connected to said third reciprocating means through a connecting rod and moved out of said tubular plunger into said die holder by said third reciprocating means, said center rod comprising a cylindrical front rod section terminating in a conical tip, a cylindrical rear rod section of smaller cross section relative to said cylindrical front rod section, a tapered intermediate rod section connected between said cylindrical front rod section and said cylindrical rear rod section, a collar disposed between said cylindrical front rod section and said tapered intermediate rod section, and a toothed portion around the periphery of said cylindrical rear rod section adjacent to said tapered intermediate rod section, and a longitudinal slot through said cylindrical rear rod section, said connecting rod comprising a longitudinal coupling hole, which receives the cylindrical rear rod section and tapered intermediate rod section of said center rod, and a longitudinal slot connected to the longitudinal slot of said center rod by a pin, the periphery of the longitudinal coupling hole of said connecting rod being meshed with the toothed portion of said tubular plunger.

* * * * *